US008348482B1

(12) United States Patent
Arbel

(10) Patent No.: US 8,348,482 B1
(45) Date of Patent: Jan. 8, 2013

(54) PENDANT LIGHT

(75) Inventor: Omer Arbel, Vancouver (CA)

(73) Assignee: Bocci Design & Manufacturing, Inc., Vancouver, B.C. (CA)

( * ) Notice: Subject to any disclaimer, the term of this patent is extended or adjusted under 35 U.S.C. 154(b) by 374 days.

(21) Appl. No.: 12/655,211

(22) Filed: Dec. 24, 2009

(51) Int. Cl.
*F21V 21/16* (2006.01)

(52) U.S. Cl. ..... 362/407; 362/363; 362/809; 362/396; 362/362; 362/391

(58) Field of Classification Search ..... 362/362, 362/809, 253, 396, 186, 189, 363, 391, 407
See application file for complete search history.

(56) References Cited

U.S. PATENT DOCUMENTS

| | | | | |
|---|---|---|---|---|
| 2,629,044 | A | 2/1953 | Marfisi | |
| 2,871,343 | A | 1/1959 | Whitney | |
| 3,090,589 | A * | 5/1963 | Schaefer | 248/318 |
| 3,336,474 | A | 8/1967 | Leibl | |
| D218,474 | S | 8/1970 | Devine | |
| 3,740,547 | A * | 6/1973 | Contratto et al. | 362/449 |
| 5,021,935 | A | 6/1991 | Gary | |
| 5,685,635 | A | 11/1997 | Barthelmess | |
| D387,448 | S | 12/1997 | Barthelmess | |
| 5,868,490 | A | 2/1999 | Barthelmess | |
| 6,076,946 | A | 6/2000 | Brouillette, III et al. | |
| D505,513 | S | 5/2005 | Rugee | |
| D536,479 | S | 2/2007 | Rugee | |
| D547,887 | S | 7/2007 | Titmarsh | |
| D556,361 | S | 11/2007 | Arbel | |
| 7,311,425 | B2 * | 12/2007 | Jervey, III | 362/407 |
| 2002/0141184 | A1 | 10/2002 | Shieh | |
| 2002/0181235 | A1 * | 12/2002 | Leung | 362/286 |
| 2003/0223238 | A1 | 12/2003 | Hsu et al. | |
| 2006/0280884 | A1 * | 12/2006 | Sexton et al. | 428/34.4 |

* cited by examiner

*Primary Examiner* — Stephen F Husar
*Assistant Examiner* — James Cranson, Jr.
(74) *Attorney, Agent, or Firm* — Todd N. Hathaway

(57) ABSTRACT

A pendant light assembly having a decorative globe with an internal light chamber, formed integrally of blown glass. The chamber is formed by reheating a portion of the blown glass globe and applying a partial vacuum to draw the glass inwardly. A secondary layer of glass inside the light chamber differs from the glass of the main globe in transparency, translucency and/or color; for example, the outer globe may be clear and the inner light chamber may be translucent to diffuse the light from the light source therein. The globe is suspended by a lighting assembly on the end of an electrical cord that is mounted to the lip of the opening into the internal light chamber. The connector assembly includes a clip mounted to the lighting element, having a plurality of flexible lobes that can be depressed to pass through the opening, and a cap threadingly mounted to the lighting element that can be tightened down to clamp the edges of the clip beneath the lip of the opening. The light chamber may have a substantially spherical shape, with the lip around the opening being formed by the edge of the wall of the main globe.

19 Claims, 8 Drawing Sheets

PENDANT LIGHT

BACKGROUND a. Field of the Invention

The present invention relates generally to lighting fixtures, and, more particularly to a pendant light assembly having a decorative blown glass globe and a method of making the same.

b. Related Art

Pendant lights are a category of light fixture in which the bulb or other light source and its shade or surround are suspended from an overlying support, such as ceiling or beam for example. Pendant lights are noteworthy for their ability to create interesting and pleasing visual effects, whether suspended singly or in a group, and are therefore popular for use in foyers, dining rooms, restaurants and similar locations.

It will be appreciated that aesthetic appeal is a critical component in installations of the kind described above. Although many prior pendant lights have been attractive in a general sense, certain challenges remain. For example, creating a diffused yet bright glow can be difficult, especially with modern halogen or LED bulbs that tend to create "point" sources of light, at least without using shades or surrounds that may be inconsistent with modern décor. Also, many prior pendant lights require unsightly brackets or similar fittings to support them on the ends of the suspension cords, or worse yet use chains and hooks or other cumbersome and/or visually unappealing arrangements.

Although aesthetic factors therefore play a lead role in decorative pendant lights, utilitarian considerations cannot be completely ignored. For example, the suspension structure of the pendant lamp must be sturdy and durable, and able to withstand loads imposed by both the weight of the light itself and also external forces such as those created by cleaning, and other disturbances. The structure must also allow the bulb or other light source to be changed or other maintenance to be carried out without excessive difficulty. Moreover, while economy is perhaps not critical as with more utilitarian lighting fixtures, it is nevertheless desirable that the decorative light fixture be manufacturable at reasonable cost.

Accordingly, there exists a need for a decorative pendant light that presents an interesting and appealing appearance. Furthermore, there is a need for such a light that produces a bright yet diffused glow using modern light sources such as halogen bulbs and LED's. Still further, there exists a need for such a pendant light that is unencumbered by external attachments that would detract from its aesthetic appeal. Still further, there exists a need for such a pendant light having a suspension structure with adequate strength and durability to withstand routine loads that will be experienced by the fixture. Still further, there exists a need for such a pendant light in which the bulb, LED, or other light source can be removed and replaced without excessive difficulty. Still further, there exists a need for such a pendant light that can be manufactured in a comparatively cost-effective manner.

SUMMARY OF THE INVENTION

The present invention addresses the problems cited above, and broadly is a pendant light assembly comprising: (a) a decorative globe, comprising a wall of light transmitting material substantially surrounding an interior volume of the globe, and a light chamber located within the interior volume of the globe and having a wall of light transmitting material and an opening at a surface of the globe, and (b) a lighting assembly, comprising a lighting element having at least one light source, an electrical suspension cord having an end connected to the lighting element so as to supply power to the at least one light source, and a connector assembly detachably mounting the lighting element to the decorative globe so that the at least one light source thereof is located in the light chamber of the globe and the electrical cord extends upwardly therefrom to suspend the pendant light assembly from an overlying support. The wall of the light chamber may comprise a concavely recessed portion of the wall of the decorative globe, that extends into the interior volume thereof, and the light transmitting material forming the walls of the decorative globe and light chamber may be blown glass.

The decorative globe may further comprise a secondary layer of light transmitting material on the wall of the light chamber, the secondary layer of light transmitting material differing in at least one light transmissive characteristic from the material of the wall of the chamber. The at least one light transmissive characteristic by which the secondary layer differs may be selected from the group consisting of transparency, translucency, color, and combinations thereof. The secondary layer of light transmitting material may comprise a secondary layer of blown glass formed on an inside surface of the wall of the light chamber.

The opening of the light chamber may comprise a necked-down opening sized smaller than the inside diameter of the light chamber, and the opening may comprise an inwardly projecting lip substantially surrounding the opening. The light chamber may be a substantially spherical chamber that meets an outer surface of the decorative globe so that an edge of the wall of the globe forms the inwardly projecting lip around the opening of the chamber.

The connector assembly detachably mounting the lighting element to the decorative globe may comprise a clip member that is mounted to the lighting element above the at least one light source, and has at least one radially extending portion that fits beneath the inwardly projecting lip around the opening of the light chamber so as to suspend the decorative globe therefrom. The radially extending portion of the clip member may comprise a plurality of resiliently flexible lobe portions that are individually depressible so as to permit the clip member to be selectively passed into and out of the opening of the light chamber.

The connector assembly may further comprise a cap member that is mounted to the lighting element and has a radially extending portion that fits over the inwardly projecting lip around the opening of the light chamber, and means for alternately raising and lowering the cap member on the lighting element so as to selectively clamp and release the radially extending portion of the clip member beneath the lip around the opening. The means for alternately raising and lowering the cap member may comprise an upwardly extending portion of the lighting element of the cap member in threaded engagement therewith, so that the cap member is selectively lowered and raised by tightening and loosening the cap member on the lighting element. The at least one light source of the lighting element may comprise at least one LED bulb mounted to a lower end of the lighting element.

The present invention also provides a method for forming the decorative globe for the lighting assembly. The method of forming the decorative globe may comprise the steps of (a) forming a blown-glass globe; (b) heating a selected portion of a wall of the blown glass globe so that the selected portion becomes workable; and (c) applying a partial vacuum to an interior of the blown glass globe so as to draw the workable selected portion of said wall inwardly to create a chamber for housing a light source of a lighting element therein. The step of heating a selected portion of the wall of the blown glass globe may comprise heating a selected portion having a diameter smaller than a predetermined diameter of a suspension clip to be mounted in the chamber.

The method may further comprise the step of applying a mass of secondary glass material to the selected area so that the secondary glass material forms a layer on an inside surface of the chamber, the secondary glass differing from the glass of the wall of the globe by at least one light-transmissive characteristic selected from the group consisting of transparency, translucency, color, and combinations thereof. The step of drawing the selected portion of the wall inwardly may comprise drawing the selected portion inwardly until the chamber has a generally spherical form.

These and other features and advantages of the present invention will be more fully appreciated from a reading of the following detailed description with reference to the accompanying drawings.

DETAILED DESCRIPTION

Figure 1:
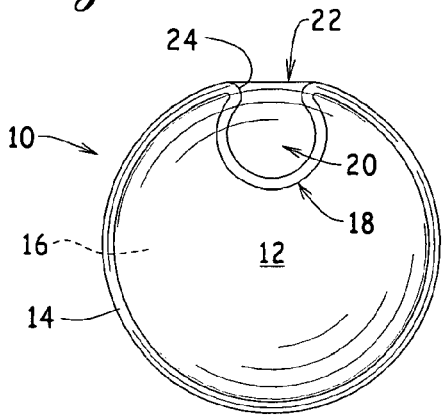
FIG. 1 is an elevational view of a decorative blown glass globe for a pendant light fixture in accordance with the present invention, showing the globe prior to installation of the light source and suspension assembly therein.

FIG. 1 shows a blown glass globe 10 for a pendant light. In the following sections, a description of making the globe will first be provided, followed by a description of the pendant light assembly of which the globe forms a part.

As can be seen in FIG. 1, the globe 10 includes a blown-glass body 12, which in the illustrated embodiment has a generally spherical form, defined by a wall 14 formed of one or more layers of glass, substantially surrounding a hollow interior volume 16. A portion of the wall 14 is formed into a pocket-like indentation 18, surrounding a partially enclosed light chamber 20 in the upper portion of the body. A necked-down opening 22 communicates between the chamber 20 and the exterior of the globe, and is surrounded by a lip 24 defining a diameter smaller than the main diameter of the chamber.

As will be described in greater detail below, the light chamber 20 serves the dual purposes of forming an inner shade or surround for the light source of the pendant light, so as to diffuse, color or otherwise modify the light projected from the source, and providing a mounting area for a structure for suspending of the globe from a ceiling or other overlying support.

a. Manufacture

FIGS. 2-12 illustrate steps in a method of making the glass globe of the pendant light, including the internal light chamber described above.

Figure 2:
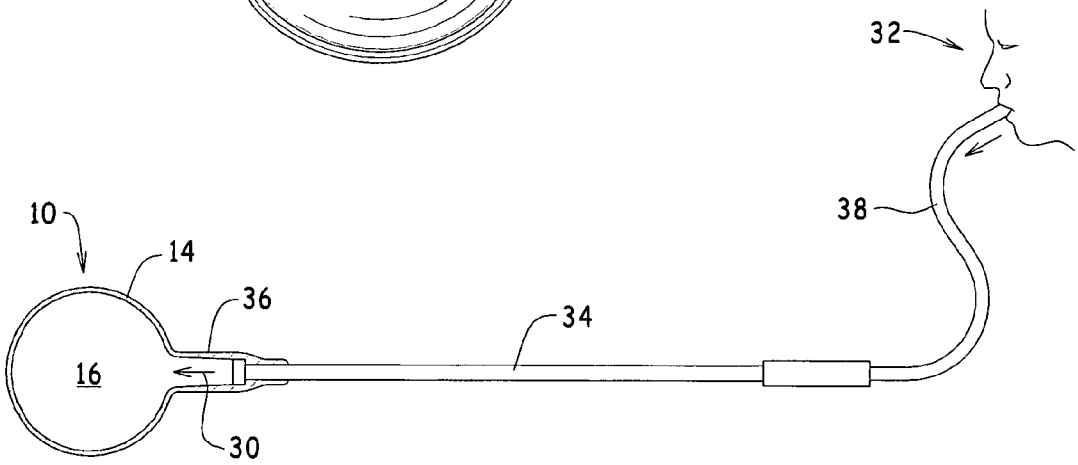
FIG. 2 is an elevational, partly cross-sectional view of a first step in the manufacture of the pendant light globe of FIG. 1, showing the manner in which a mass of molten glass is inflated to form the body of the globe.

FIG. 2 shows the manner in which the body of the globe 10 is initially formed, by inflating a first mass of molten glass with air forced into the interior 16 of the globe under pressure, as indicated by arrow 40. As is conventional in glassblowing, this may be done by a craftsman 32 blowing into the mass via a blow tube 34 that is attached to a neck 36 of the molten glass, optionally using a flexible hose 38. It will be understood the basic steps of heating and preparing the body of glass, attaching a blow tube, applying pressure and initially shaping the globe are know to those skilled in the relevant art, so are not described here in detail.

Figure 3:
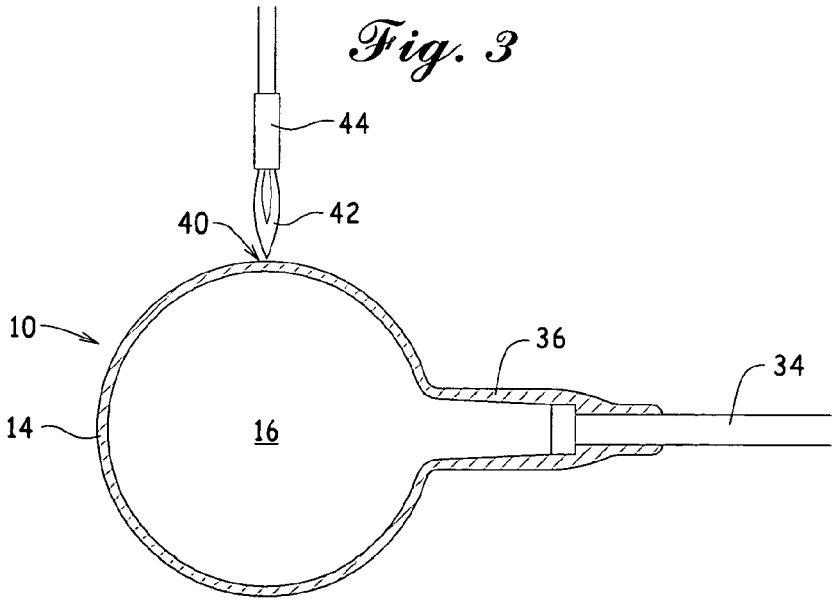
FIG. 3 is a cross-sectional view of the body of the globe of FIG. 2, showing the manner in which a selected portion of the body is heated to become workable in a following step in the making of the pendant light globe of FIG. 1.

Once the body of the globe has been given its principal shape (e.g., spherical the embodiment illustrated in FIGS. 1-12) the glass is allowed to cool to level such that the wall 14 of the globe becomes generally rigid and will resist collapse during the subsequent stages. Spot heating is then applied a selected location 40 of the globe, that will be at the upper end or top of the globe when completed, for example by applying the flame 42 to the selected area using a torch 44 as shown in FIG. 3. The spot heating is confined to a relatively restricted area of the wall of the globe, that is selected such that the glass will yield to give an opening having a predetermined diameter slightly smaller than the suspension pieces of the lighting assembly, as will be described below.

Figure 4:
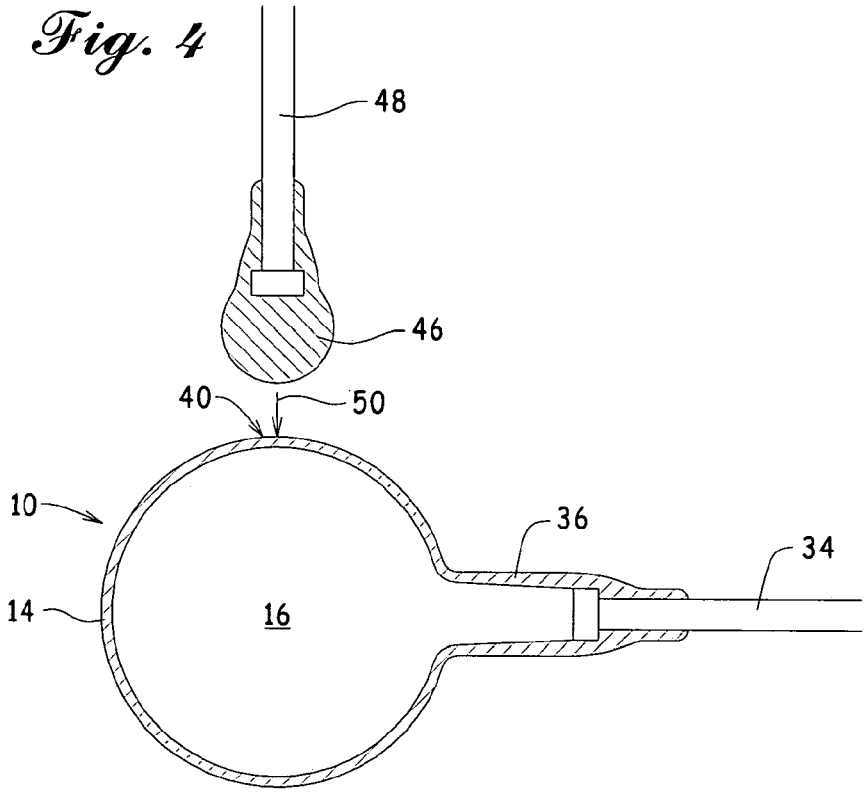
FIG. 4 is a cross-sectional view similar to FIGS. 3-4, showing a following step in the making in the pendant light globe of FIG. 1, in which a secondary mass of molten glass is applied to the portion of the main body that has been heated as shown in FIG. 3.

The spot heating is continued until the affected area of the glass forming well 13 again becomes soft and workable, at which point a secondary body of preheated, molten glass 36, supported on the end of another blowpipe 48 or other suitable implement, is applied to the selected portion 40 of the main body of the globe, as indicated by arrow 50 in FIG. 4. Although the glass material making up the secondary body 46 may be of the same character as that of the main mass forming the body of the globe, in preferred embodiments it may have distinctly contrasting light-transmissive qualities, particularly in terms of transparency, translucency and/or color. For example, the glass forming the body of the globe may be transparent while that of the secondary mass may be translucent, thus serving to diffuse and spread the light from LEDs, halogen bulbs or other light source that is subsequently mounted within the chamber, as will be described in greater detail below. Similarly, the glass of the main globe may be clear or have a first color or colors, while the layer of secondary material may have a different color or colors.

Figure 5:
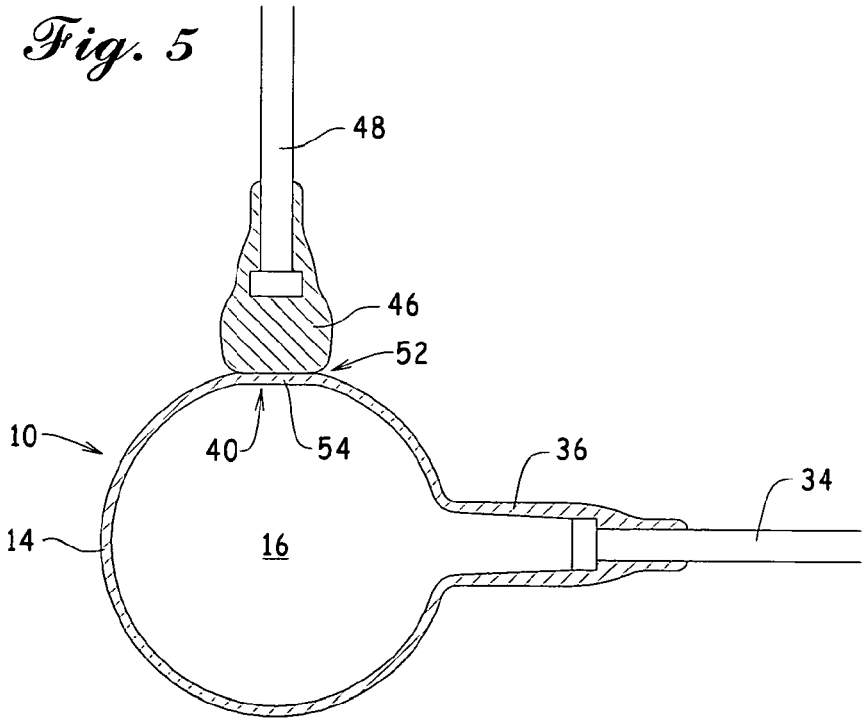
FIG. 5 is a cross-sectional view similar to FIGS. 3-4, showing a following step in the making of the blown glass pendant light globe of FIG. 1, in which the secondary mass becomes adhered to the reheated portion of the body of the globe.

As can be seen with reference to FIG. 5, the secondary body of glass 46 is held against the selected portion 40 of the globe until the two bodies become fused along an interface 52, with the affected area 54 of wall 14 flattening or depressing somewhat so as to increase the size of the contact patch and therefore the area of the fused interface 52. When a satisfactory degree of fusion has been established, the secondary glass body is severed, for example using hand-operated shears 56 or another suitable implement, so that a first portion 46' is left adhered to the surface of the globe, while the other portion 46' of the secondary body remains attached to the blow tube 48 and is withdrawn.

Figure 6:
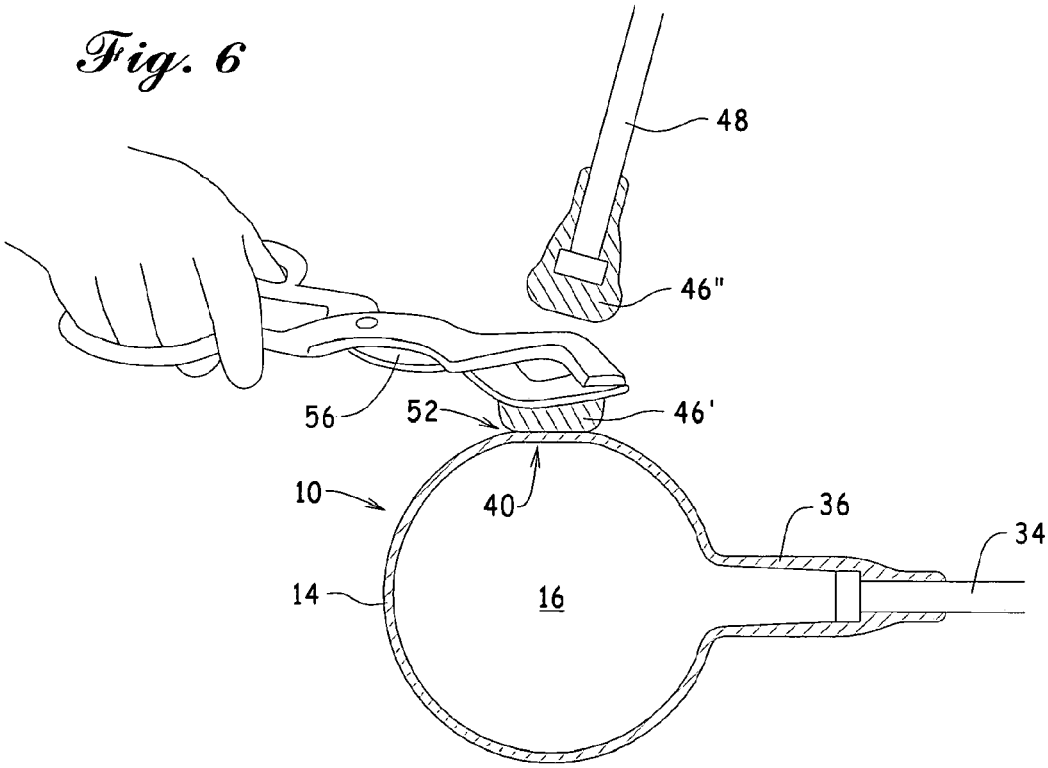
FIG. 6 is an elevational, partly cross-sectional view showing a following step in the making of the blown glass pendant light globe of FIG. 1, in which the secondary molten body of glass is severed so a selected portion thereof remains adhered to the surface of the main body of the globe.
Figure 7:
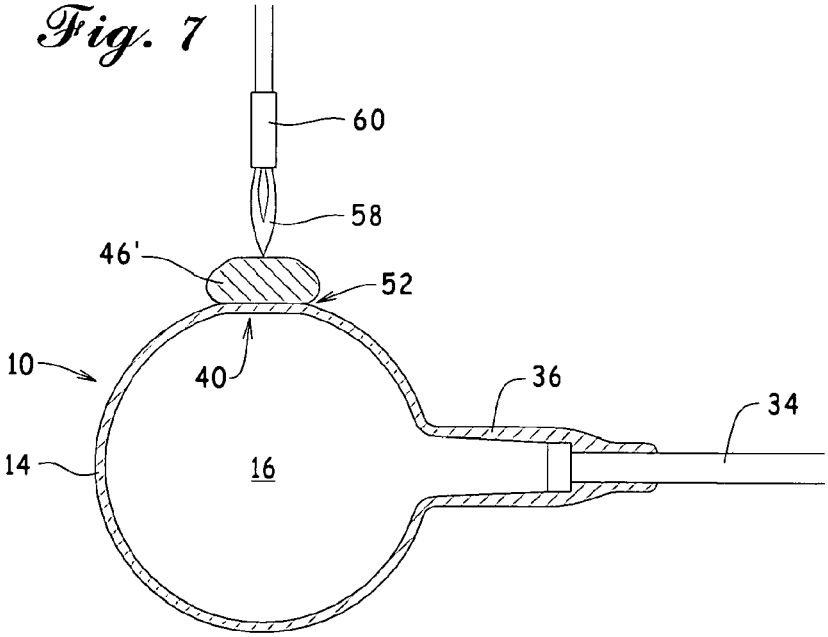
FIG. 7 is a cross-sectional view, similar to FIGS. 3-6, showing a following step in the making of the blown glass pendant light globe of FIG. 1, in which additional heat is applied to the severed portion of the secondary glass body so that the severed portion remains workable.
Figure 8:
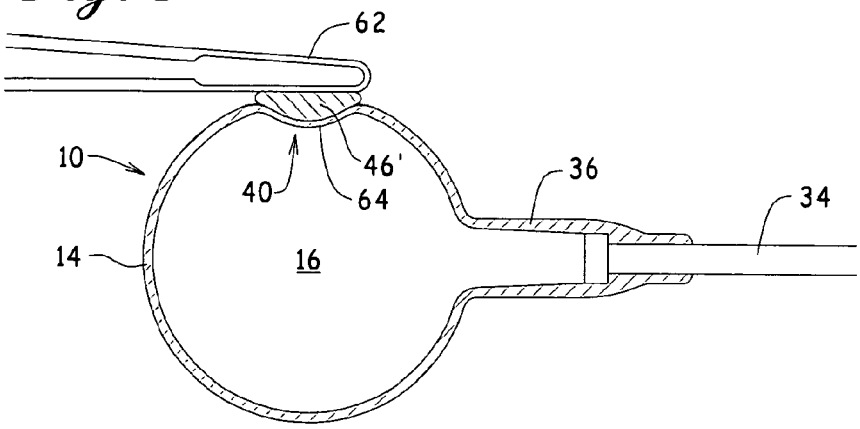
FIG. 8 is a cross-sectional view, similar to FIGS. 3-7, showing a following step in the method of making the blown glass pendant light globe of FIG. 1, in which the severed, reheated body of molten glass is pressed into the selected area of the main globe so as to form an initial depression therein.

The volume of the severed portion 46' of the secondary body of glass is selected such that it will form a layer over the interior of the subsequently formed pocket-shaped light chamber, as will be described in greater detail below. After being severed as shown in FIG. 6, additional heat is applied to the adhered portion 46' of the secondary body, using for example a flame 58 directed from a torch 60 as shown in FIG. 7. The reheating is preferably performed until the mass 46' is fully workable, as well as the underlying area 40 of the wall 14 of the globe; the severed mass 46' is then pressed into the wall 14 in area 40, using for example a side of a pair of tongs 62 or similar implement as shown in FIG. 8, so as to both flatten out the secondary mass 46' and initiate a concave indentation 64.

Figure 9:
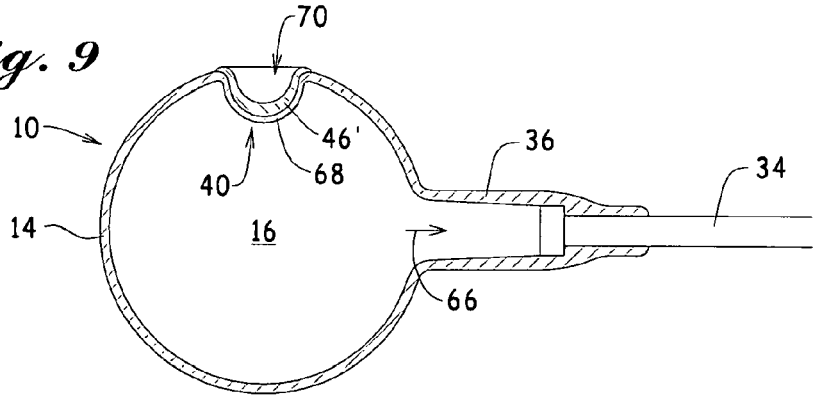
FIG. 9 is a cross-sectional view of similar to FIGS. 3-8, showing a following step in the making of the blown glass globe of FIG. 1, which air is withdrawn from the interior of the body of the globe so as create a partial vacuum that draws the softened portion of the globe and the associated portion of the secondary glass body inwardly to form a cavity in the wall of the globe.

With the severed mass 46' of secondary glass material and also the wall 14 of the globe in area 40 still fluid at a workable temperature, the worker next draws air from within the interior 16 of the globe through the blow tube 34, in the direction indicated by arrow 66 in FIG. 9, so as to create a partial vacuum within the globe. The pressure differential causes the molten glass in area 40 to form an inward bulge 68, creating an initial depression or "dimple" 70 in area 40. Being that both layers (i.e., the layers of main and secondary glass materials) are molten and fused, they form a laminate that conforms to the concave contour of the depression.

Figure 10:
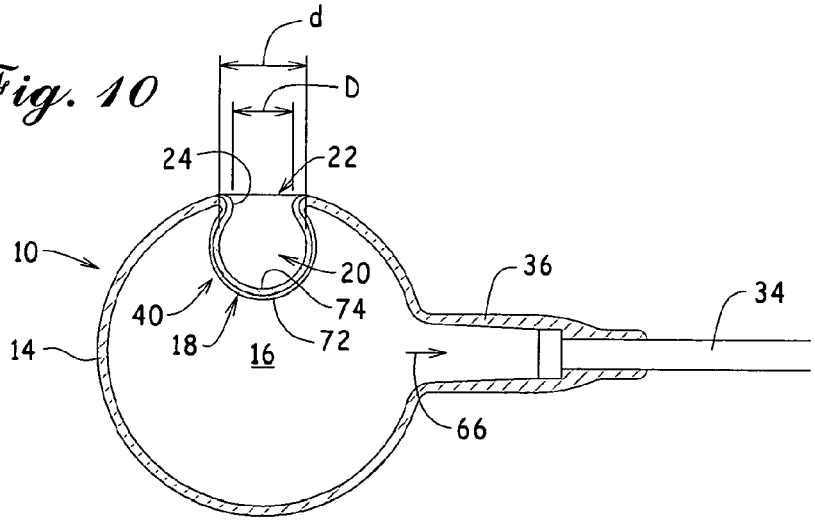
FIG. 10 is a cross-sectional view, similar to FIGS. 3-9, showing a following step in the manufacture of the blown glass globe of FIG. 1, in which continued application of the partial vacuum to the interior of the globe causes the indentation formed by the softened area of the wall, and the associated portion of the secondary glass body to expand into the interior of the main body to form a lighting chamber having a generally spherical form and a narrowed opening at the surface of the main body.
Figure 11:
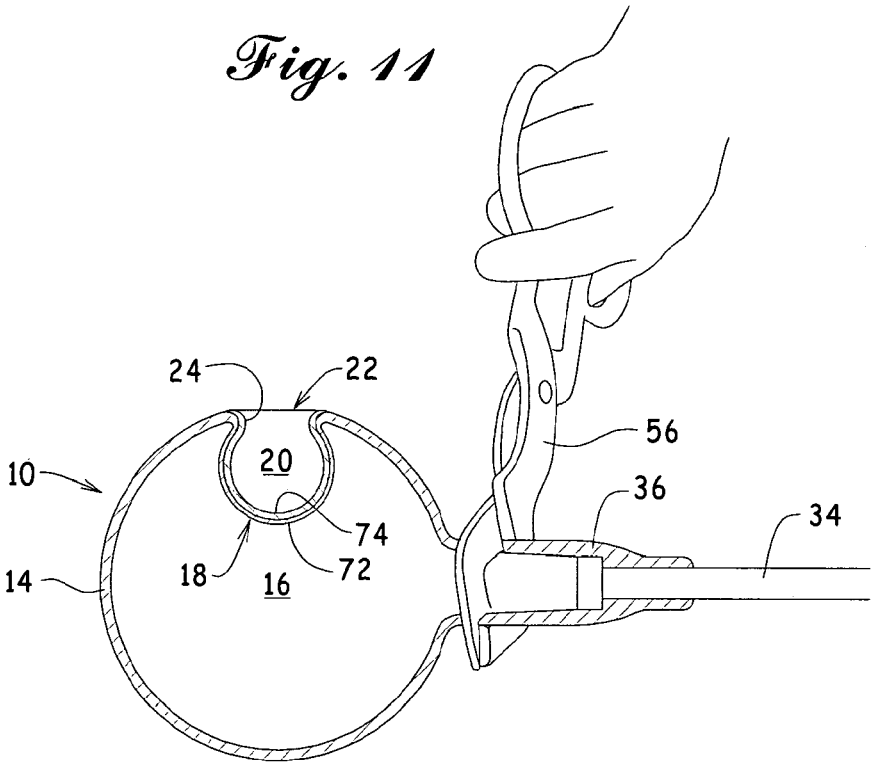
FIG. 11 is a cross-sectional, environmental view, similar to FIGS. 3-10, showing a following step in the making of the globe of FIG. 1, in which the main body of the globe is removed from the attached blow pipe using a cutting tool and the opening subsequently smoothed over and sealed.

Continued withdrawal of air, as indicated by arrow 66 in FIG. 10, results in the initial depression expanding into the interior 16 of the globe in a generally spherical shape resembling a "bubble", with an outside layer 72 formed from the selected portion of wall 14 and an inside layer 74 formed from the secondary mass of glass material, both spreading out and thinning accordingly. However, since, as described above, the reheating steps (as shown in FIGS. 3 and 7) were confined to a restricted area 40, the edges of the wall 14 around the depression remain relatively rigid and unyielding while the softer material within is drawn into the interior of the globe in a bubble-like fashion. The worker is thus able to expand the "bubble" until it forms a chamber 20 having a first, relatively large diameter "D", while the edge of the wall 14 remains to form the lip 24 of an opening 22 having a second, relatively smaller diameter "d". Thus, the worker is able to form an opening having a size that will cooperate with the suspension hardware of the pendant light, as will be described below.

Figure 12:
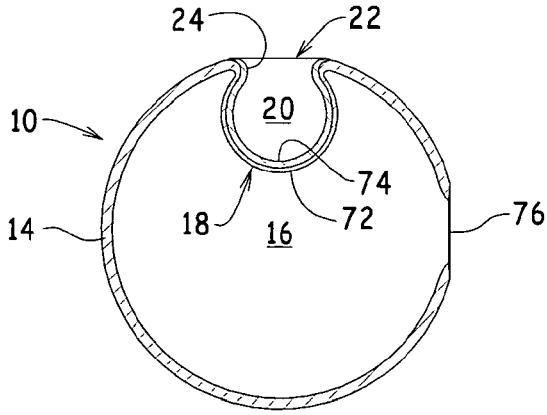
FIG. 12 is a cross-sectional view, similar to FIGS. 3-11, showing the body of the globe as completed.

Once formation of the light chamber 20 and other features (such as described below) has been completed, the worker reheats the neck 36 of glass by which the globe is connected to blow tube 34, using for example the torch and flame described above, and then severs the neck using the shears 56 or another suitable implement. The blow tube and associated portion of neck 36 are removed, and the remaining stub is flattened and smoothed over using the tongs or other suitable implement so as to form a patch 76 as shown in FIG. 12, that closes off the opening and seals the interior 16 of the globe.

Figure 13:
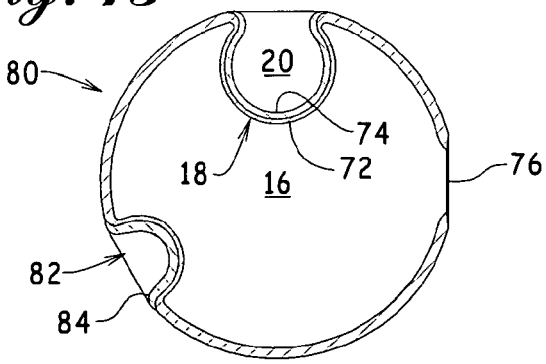
FIG. 13 is a cross-sectional view, similar to FIG. 12, of a second globe in which the body of the globe has a plurality of indentations formed therein, formed by steps similar to those illustrated in FIGS. 3-10.

FIG. 13 illustrates one manner in which the globe may incorporate additional decorative features. In the example that is shown therein, the globe 80 includes a secondary depression 82 having a circular rim 84 and outer and inner layers 86, 88 of glass with differing characteristics, separate from the main lighting chamber 20. The secondary depression is formed in substantially the same manner as chamber 20, except for the expansion of the depression is arrested at about the "dimple" stage shown in FIG. 9. The inner layer 88 may, for example, be formed of glass having a color different from that of both the main body of the globe and the other inside layer 74. It will be understood that larger and smaller decorative depressions may be formed in a similar manner, and at various locations about the body of the globe as desired.

b. Lighting Assembly

FIGS. 14-20 show a preferred embodiment of lighting assembly for use with a blown glass bulb as described above, to form a completed pendant light assembly.

Figure 14:
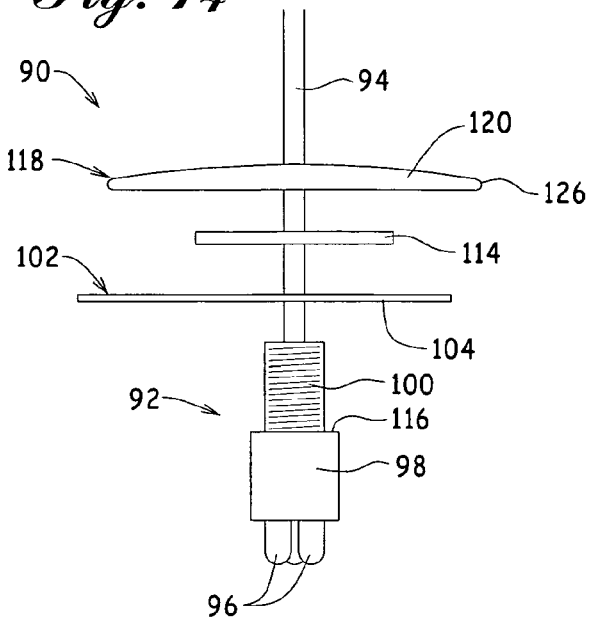
FIG. 14 is an elevational, exploded view of a lighting assembly by which the blown glass globe of FIG. 1 is suspended from an overlaying support.
Figure 15:
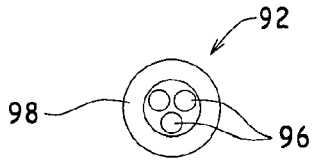
FIG. 15 is a bottom plan view of the LED lighting element of the suspension assembly of FIG. 14, that provides the light source of the pendant light.

As can be seen in FIG. 14, the lighting assembly 90 includes a lighting element 92 attached to the end of an electrical cord 94 that also serves as a suspension line. In the illustrated embodiment the lighting unit includes a plurality of LED bulbs 96 as the light source, although it will be understood that other embodiments may utilize halogen bulbs or other incandescent or non-incandescent bulbs as sources. The LED bulbs 96 are mounted to and protrude from the lower, distal end of an insulator body 98 that houses the ends of the bulbs and wires and the associated connections, with an externally threaded sleeve portion 100 extending upwardly therefrom around the wire 94; in the illustrated embodiment, body 98 is generally cylindrical in shape, which presents a clean appearance to the extent that it is visible through the globe, although it will be understood that this is somewhat arbitrary and that other shapes may be used.

Figure 16:
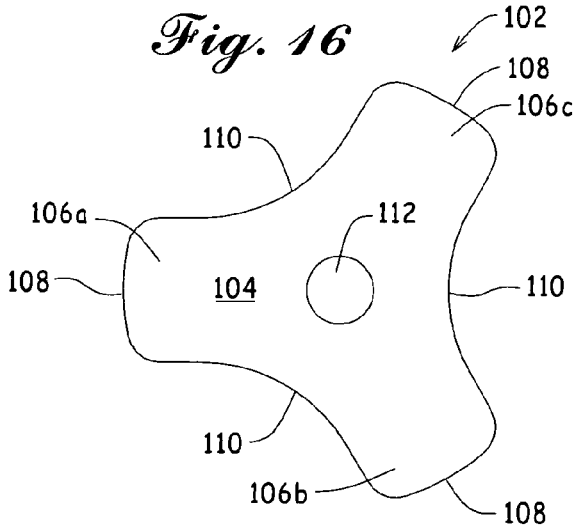
FIG. 16 is a bottom plan view of the suspension clip of the lighting assembly of FIG. 4, that circumferentially engages the lip of the chamber in which the assembly is installed.

With further reference to FIG. 14, the component next above the lower end of the lamp body is suspension clip 102. The suspension clip is preferably formed of a flat plate 104 of spring steel, semi-rigid plastic or other rigid but resiliently flexible material, having a plurality of generally flexible wing-like tabs on lobes. As can be seen in FIG. 16, the suspension clip of the illustrated embodiment includes three radially extending lobes 106*a*, 106*b*, 106*c*: The end surfaces 108 of the lobes are somewhat flattened but convexly curved, each representing a segment (roughly 10° in the embodiment that is illustrated) of a circle matching the diameter of plate 104, the diameter being sized somewhat larger than the diameter of the opening 22 into the light chamber; "cutouts" formed by concave side edges 110 enable the wing like lobes to be bent or deflected in order to pass through the opening, as will be described below, after which they spring back to the original diameter. A bore 112 at the center of the plate is sized to receive the extension sleeve 100 of the light source body 98, which preferably slides freely through bore 112 without forming a threaded engagement therewith. It will be understood that in some instances, the clip may have more or fewer lobes or tabs than in the illustrated embodiment, and that they may be broader or narrower than those shown.

Figure 17:
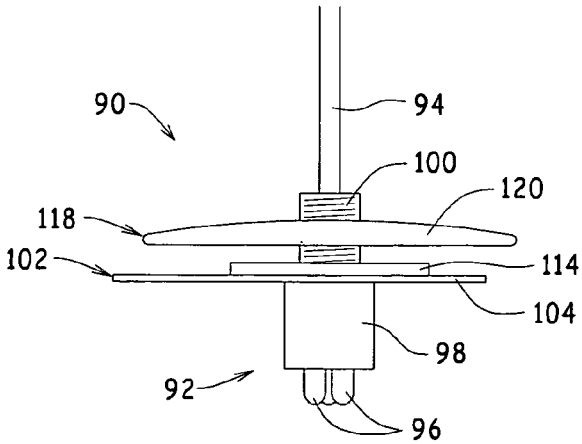
FIG. 17 is an elevational view of the lighting assembly of FIG. 14, showing the manner in which the components thereof cooperate when assembled together.

Located next above clip 102 in the assembly is a circular, washer-shaped nut member 114, having a central bore (not shown) that forms a threaded engagement with the extension 100 of the light body. As can be seen in FIGS. 14 and 17, the washer-shaped nut member 114 acts to secure the mounting clip member 102 on the body of the light source unit: To assemble the pieces, the suspension clip 102 is first slipped over the wire 94 and onto the extension 100 of the light body, the extension passing through bore 112 until the plate comes into contact with a shoulder 116 between the threaded extension 100 and the main portion of body 98. The washer member 114, having also been slipped over wire 94, is then threaded onto extension 100 and tightened down against the top of the plate 104 of the suspension clip, so as to sandwich the clip between itself and shoulder 116. In this manner, the mounting clip 102 is held securely in place against the longitudinal movement on body 98, but is still able to rotate thereon with the application of sufficient force to overcome the frictional engagement between the surfaces of the clip and those of the shoulder and locking nut 114. It will be understood that in some cases a press-fit or friction-fit washer may be used in place of the threaded nut that is shown.

Above the mounting clip and lock washer is a cap member 118 formed of a circular plate member 120 having a threaded central bore (not shown). The plate member 120 in the illustrated embodiment has a slightly domed upper surface and a generally flat lower surface, which provides the dual advantages of increasing the thickness and therefore the strength of the plate member and also providing an aesthetically pleasing appearance, however, it will be understood that the decorative aspect is here somewhat arbitrary and that other shapes may be used. The cap 118 is installed by again slipping it over wire 94 and threading it onto the extension 100 of the lighting body 98, where it defines a vertical gap of varying size between its lower surface and the upper surface of the suspension clip 102.

As can be seen with further reference to FIGS. 14 and 17, it can be seen that the edge 126 of the circular cap member 118 is preferably smoothly radiused. Similarly, the main contours of the plate 104 of the mounting clip are smoothly curved rather meeting at sharp corners. The use of smooth contours reduces the possibility of the glass globe being chipped or otherwise damaged during installation of the lighting assembly, as described below.

Figure 18:
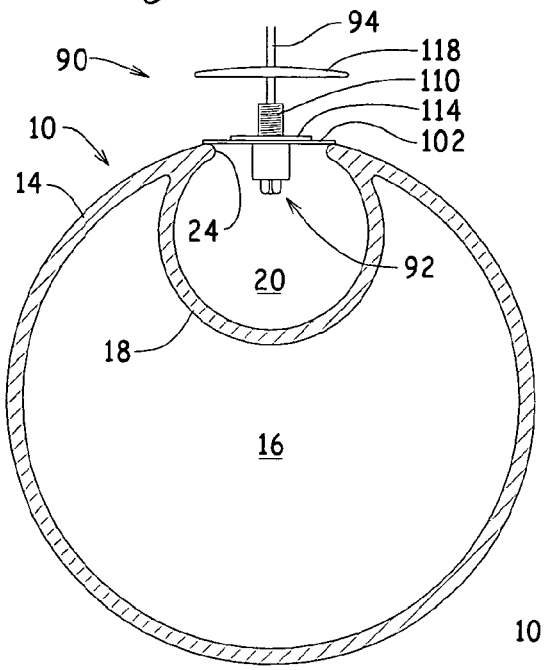
FIG. 18 is an elevational view of the lighting assembly of FIGS. 14-17, showing the manner in which the suspension clip thereof is inserted through the opening into the semi-spherical light chamber in the body of the globe.
Figure 19:
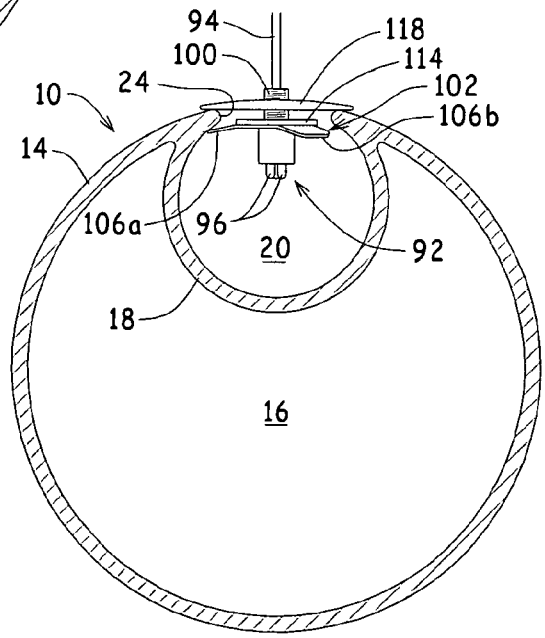
FIG. 19 is an elevational view of the lighting assembly of FIGS. 14-17, similar to FIG. 18, showing the manner in which the clip member and circular cap member are tightened together to engage the circumferential lip of the light chamber of the blown glass globe.
Figure 20:
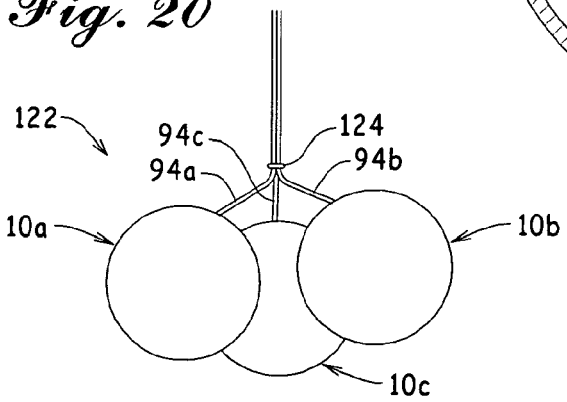
FIG. 20 is an elevational view of a plurality of globes similar to that of FIG. 1, with the suspension assemblies installed as shown in FIG. 19 and then gathered together to form a multi-light display.
Figure 21:
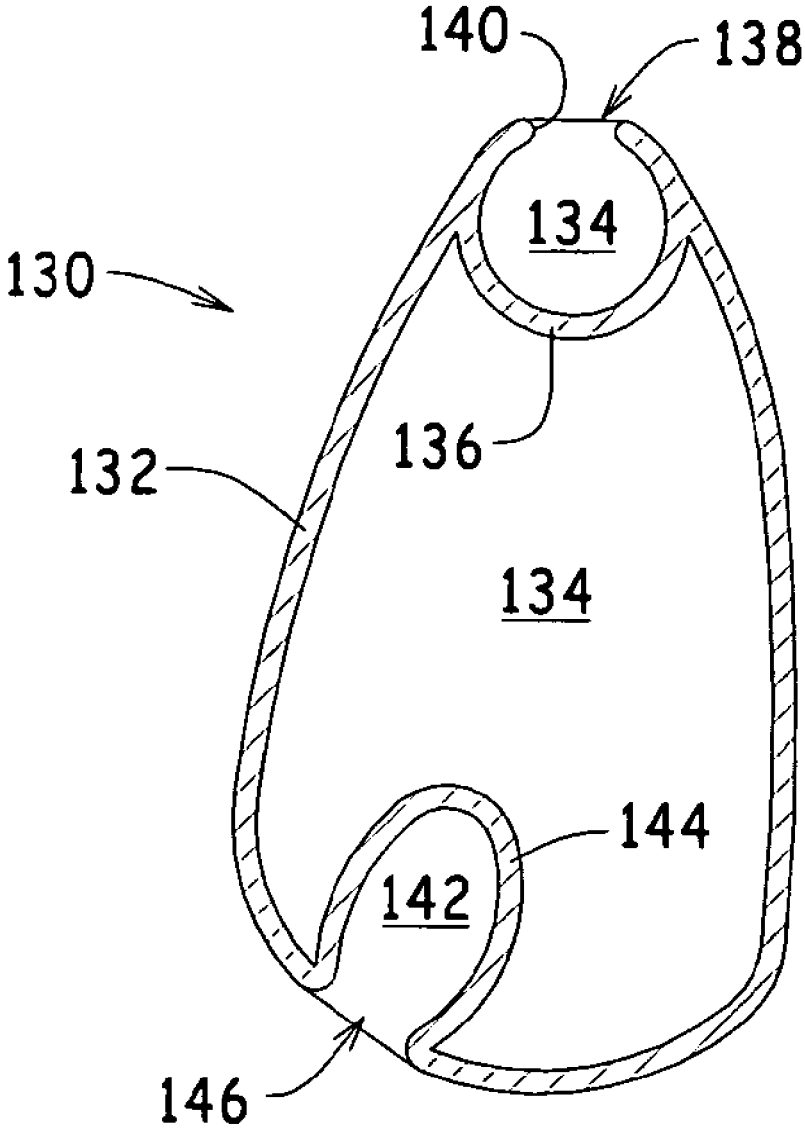
FIG. 21 is a cross-sectional view of a blown glass globe for a pendant light in accordance with another embodiment of the invention, formed in a manner similar to that illustrated in FIGS. 2-12 but having an exemplary teardrop configuration rather than a spherical shape.

FIGS. 18-19 show the steps in mounting the suspension assembly 90 to a blown glass globe 10 as that described above.

As can be seen in FIG. 18, the cap member 18 of the assembly is first backed off the threaded extension of the light body so as to increase the size of the gap between it and suspension clip 102. The suspension clip is then placed against the lip 24 of the reduced diameter opening 22 into light chamber 20, so that the light source or sources are disposed in the chamber. The worker then flexes one or more of the lobes 106*a-c* of the suspension clip downwardly so as to pass under lip 24, using finger pressure or a suitable implement, sliding the assembly to one side or another and/or rotating the suspension clip as necessary.

Once all of the lobes have the suspension clip have been worked under lip 24 and into the interior of chamber 20, the cap member 118 is threaded onto extension 100 and tightened down to reduce the gap between it and the suspension clip. As this is done, the lobes of the clip are drawn upwardly against the chamber opening, so that the lobes make contact with the underside of lip 24 to form a stable, load bearing engagement therewith about the entire perimeter of the opening. In so doing, the resilient lobes may flex downwardly to an extent, so as to accommodate the slope/curvature on the lower side of the lip while still forming a firm engagement therewith, which also helps to center the assembly within the opening.

It will be appreciated that when the suspension assembly is being installed, the operator is able to resiliently bend the lobes individually in order to reduce the effective diameter of the suspension clip and therefore allow it to pass through the opening into the light chamber. Once the clip has fully entered the chamber, however, the lobes spring resiliently back to their original diameter, so that the resistance of all of the lobes works to prevent the clip from being pulled back out of the opening. The resistance is maximized by the centering action described in the preceding paragraph, with the frictional engagement between the glass and both the suspension clip and the cap member helping to prevent the connection from shifting off-center. The light can therefore be suspended by a wire 94 and the connection formed by the lighting assembly will be sufficiently strong to resist normal loads over the life of the fixture. However, in the event that a bulb or other light source needs to be changed, or other maintenance needs to be performed, the lighting unit can be conveniently removed from the globe by simply unscrewing the cap member 118 and then depressing the lobs 106*a-c* individually or as a group until all have exited through the opening. The maintenance work can then be performed, and the lighting assembly can then be re-installed in the manner described above.

Pendant lights constructed using globes and suspension assemblies as described above can be hung singly or in multiples, with their suspension wires parallel to one another. Additionally, a plurality of lights can be gathered together into a group, such as the group 122 in FIG. 20 made up of three globes 10*a*, 10*c*, 10*b*, with the associated wires 94*a*, 94*b*, 94*c* collected together and held by a ring 124 or similar fitting so that only a single wire appears to extend between the group and the ceiling or other support.

With reference again to FIG. 19, it will be appreciated that in order to be visible to an observer, light from the LED's 96 or other light source must first pass through the wall 18 of the mounting chamber, and then through the wall 14 of the main globe itself. Hence, to the extent that the layer of secondary glass material that lines the chamber (e.g., see FIG. 10) is translucent or semi-opaque, or has other light scattering qualities, the light will be defused rather than appearing as a point source; the result is an intriguing and attractive effect in which a "bubble" of diffused light (formed by the chamber containing the light source) appears to float inside a larger bubble formed by the main body of the globe. Visual interest can be heightened by using differing and contrasting colors as desired, as well as by applying decoration, texturing or other effects to the main globe, using techniques known to those skilled in the relevant art. Furthermore, while the diffused light effect is notably attractive and pleasing in many environments, it will be understood that in some embodiments the material in the wall of the mounting pocket may be completely or partially transparent instead.

For purposes of illustration, the invention has been described above primarily with reference a globe that is generally spherical in form. It will be understood, however, that virtually any shape can be used. For example, FIG. 1 shows a globe 130 having a generally teardrop-shaped wall 132 surrounding the interior volume 134. Apart from the shape, which can be achieved during the initial blowing/molding phase, similar to that shown in FIG. 2, the globe 130 is structurally similar to that described above, and can be used with the same lighting assembly. In particular, the light chamber 134, defined by a pocket-shaped recess 136 in the wall, is located in the upper end of the main body of the globe; the chamber is formed in substantially the same manner as described above with reference to the FIGS. 6-12, and likewise includes a necked-down opening 138 and surrounding lip 140 that cooperate with the components of the suspension assembly in the manner previously described. Also included is a decorative indention 142, partially surrounded by the concave wall 144 and having an entrance opening 146, which corresponds to and is formed in an essentially similar manner as the decorative indentation 82 described above with reference to FIG. 13. It will therefore be understood that the globes may have a wide range of different shapes, with light chambers and attachment features (the necked-down opening and surrounding lip) that allow the same or similar suspension hardware to be used across the entire line.

It is to be recognized that various alterations, modifications, and/or additions may be introduced into the constructions and arrangements of parts described above without departing from the spirit or ambit of the present invention.

What is claimed is:

1. A pendant light assembly, comprising:

a decorative globe, comprising:

a wall of blown glass substantially surrounding an interior volume of said globe; and a light chamber located within said interior volume of said globe and having a wall of blown glass and an opening at a surface of said globe, said light chamber being formed of a concavely recessed, substantially continuous portion of said blown glass wall of said decorative globe that has been drawn into said interior volume of the globe; and a lighting assembly comprising:

a lighting element having at least one light source;

a suspension cord having an end operatively connected to said lighting element so as to supply power to said at least one light source; and a connector assembly mounting said lighting element to the decorative globe so that said at least one light source thereof is located in said light chamber of the globe and said cord extends therefrom to suspend said pendant light assembly from an overlying support.

2. The pendant light assembly of claim 1, wherein said decorative globe further comprises:

a secondary layer of blown glass on said wall of said light chamber, said secondary layer of light transmitting material differing in at least one light-transmissive characteristic from said material of said wall of said chamber.

3. The pendant light assembly of claim 2, wherein said at least one light-transmissive characteristic by which said secondary layer of blown glass differs is selected from the group consisting of:

transparency;

translucency;

color; and combinations thereof.

4. The pendant light assembly of claim 3, wherein said secondary layer of blown glass comprises:

a secondary layer of blown glass laminarly fused to said wall of blown glass so as to form an inside surface of said wall of said light chamber.

5. The pendant light assembly of claim 1, wherein said opening of said light chamber comprises:

a necked-down opening sized smaller than an inside diameter of said light chamber.

6. The pendant light assembly of claim 5, wherein said opening of said light chamber comprises:

an inwardly-projecting mounting lip substantially surrounding said opening of said light chamber.

7. The pendant light assembly of claim 6, wherein said light chamber is a substantially spherical chamber meeting an outer surface of said decorative globe so that an edge of said wall of said globe forms said inwardly-projecting mounting lip around said opening of said chamber.

8. The pendant light assembly of claim 6, wherein said connector assembly mounting said lighting element to said decorative globe comprises:

a clip member that is mounted to said lighting element above said at least one light source and has at least one radially extending portion that fits beneath said inwardly-projecting mounting lip around said opening of said light chamber so as to suspend said decorative globe therefrom.

9. The pendant light assembly of claim 8, wherein said radially extending portion of said clip member comprises:

a plurality of resiliently flexible lobe portions that are individually depressible so as to permit said clip member to be selectively passed into and out of said opening of said light chamber.

10. The pendant light assembly of claim 9, wherein said connector assembly further comprises:

a cap member that is mounted to said lighting element and has a radially extending portion that fits over said inwardly-projecting mounting lip around said opening of said light chamber; and means for alternately raising and lowering said cap member on said lighting element so as to selectively clamp and release said radially extending portion of said clip member beneath said lip around said opening.

11. The pendant light assembly of claim 10, wherein said means for alternately raising and lowering said cap member comprises:

an upwardly extending portion of said lighting element having said cap member in threaded engagement therewith, so that said cap member is selectively lowered and raised by tightening and loosening said cap member on said lighting element.

12. The pendant light assembly for claim 11, wherein said at least one light source of said lighting element comprises:

at least one LED bulb mounted to a lower end of said lighting element.

13. A decorative globe for a pendant light assembly, comprising:

a wall of blown glass substantially surrounding an interior volume of said globe; and a light chamber for receiving a lighting assembly, said light chamber being located within said interior volume of said globe and having a wall of blown glass and an opening at a surface of said globe, said light chamber being formed of a concavely recessed, substantially continuous portion of said blown glass wall of said decorative globe that has been drawn into said interior volume of said globe.

14. The decorative globe of claim 13, wherein said decorative lobe further comprises:

a secondary layer of blown glass on said wall of said light chamber, said secondary layer of light transmitting material differing in at least one light-transmissive characteristic from said material of said wall of said chamber.

15. The decorative globe of claim 14, wherein said at least one light-transmissive characteristic by which said secondary layer of blown glass differs is selected from the group consisting of:

transparency;

translucency;

color; and combinations thereof.

16. The decorative globe of claim 15, wherein said secondary layer of blown glass comprises:

a secondary layer of blown glass laminarly fused to said wall of blown glass so as to form an inside surface of said wall of said light chamber.

17. The decorative globe of claim 13, wherein said opening of said light chamber comprises:

a necked-down opening sized smaller than an inside diameter of said light chamber.

18. The decorative globe of claim 17, wherein said opening of said light chamber comprises:

an inwardly-projecting mounting lip substantially surrounding said opening of said light chamber for being engaged by a connector of said light assembly.

19. The decorative globe of claim 18, wherein said light chamber is a substantially spherical chamber meeting an outer surface of said decorative globe so that an edge of said wall of said globe forms said inwardly-projecting mounting lip around said opening of said chamber.

* * * * *